US005647117A

United States Patent [19]

Kurita

[11] Patent Number: 5,647,117

[45] Date of Patent: Jul. 15, 1997

[54] METHOD FOR SEALING CONNECTED PORTIONS OF LEAD WIRES OF A SWITCH DEVICE

[75] Inventor: Tsutomu Kurita, Miyazaki, Japan

[73] Assignee: Kabushiki Kaisha Honda Lock, Miyazaki, Japan

[21] Appl. No.: 535,614

[22] Filed: Sep. 28, 1995

Related U.S. Application Data

[62] Division of Ser. No. 343,895, Nov. 17, 1994.

[30] Foreign Application Priority Data

Nov. 24, 1993 [JP] Japan ..... 5-062850
Dec. 24, 1993 [JP] Japan ..... 5-328564

[51] Int. Cl.[6] ..... H01H 11/00

[52] U.S. Cl. ..... 29/622; 29/855; 264/272.11; 200/302.1

[58] Field of Search ..... 29/622, 855; 264/272.11; 200/302.1, 302.2

[56] References Cited

U.S. PATENT DOCUMENTS 3,328,512 6/1967 Lembke et al. ..... 29/855
4,027,385 6/1977 Deubel ..... 29/622

FOREIGN PATENT DOCUMENTS 4-22492 5/1992 Japan .

*Primary Examiner*—P. W. Echols
*Attorney, Agent, or Firm*—Nikaido Marmelstein Murray & Oram LLP

[57] ABSTRACT

In a switch device, a switch is provided in a tightly closed switch chamber in a casing, and an operating element is advanceably and retreatably inserted into the switch chamber through an opening in the casing. An actuating member, connected to an inner end of the operating element for operating the switch, is provided in the switch chamber and has a fitting hole which including a small diameter portion and a large diameter portion. The inner end of the operating element is passed through a sealing member for sealing between the operating element and the opening, and is fitted into the small diameter portion of the fitting hole to form an annular seal clamping portion between an inner peripheral surface of the large diameter portion of the fitting hole and an outer peripheral surface of the operating element. An outer peripheral surface of the sealing member is secured to the casing, and an inner peripheral surface of the sealing member is clamped by the seal clamping portion. Thus, it is possible to insure an intended sealing function for a long period of time.

3 Claims, 6 Drawing Sheets

METHOD FOR SEALING CONNECTED PORTIONS OF LEAD WIRES OF A SWITCH DEVICE

This is a divisional of application Ser. No. 08/343,895 filed Nov. 17, 1994.

BACKGROUND OF THE INVENTION

1. Field of the Invention

The present invention relates to a switch device used for detecting, for example, a shifted state of a transmission, an operational state of a brake or the like in a vehicle, and a method for sealing the connected portions of lead wires of the switch device.

2. Description of the Prior Art

A conventional switch device used for detecting a brake, a back gear or the like in a vehicle is disclosed, for example, in Japanese Utility Model Publication No. 22492/92.

In the prior art switch device of this type, an operating element is inserted from outside through an opening into a tightly closed switch chamber in which a switch is accommodated, and a flexible sealing member penetrated by the operating element seals the opening. The switching operation of the switch is carried out by cooperation of an urging of the operating element with a resilient force of a spring. If an external force is applied to an outer end of the operating element, the operating element is retreated to operate the switch. The operating element repeats its advancing and retreating movements every time the switching operation of the switch is carried out.

In the prior art switch device, however, an inner peripheral edge of a through-hole in the sealing member is merely fit in an annular groove which is formed around an outer periphery of the operating element. Therefore, the fitted portion of the sealing member may be stripped off and slipped off from the annular groove, resulting in incorrect sealing of the device. Particularly, when the switch device is used for detection of the shifted state of the transmission of the vehicle, a problem occurs if such strip-off or slip-off of the sealing member occurs because transmission oil can enter the switch chamber hindering the switching operation.

To insure a switching accuracy for a long period of time, it is required that the operating element is always operated accurately along a predetermined path. In the prior art switch device, however, the following problem is encountered. A guide means for assisting the accurate operation of the operating element is not provided for the operating element. Particularly, an inner end of the operating element is in a free state and for this reason, the operating element may fall down or be deflected during operation thereof, thereby reducing the accuracy of the switching operation, resulting in a non-reliable device.

In addition, in the switch device of this type, the amount of displacement of a portion to be detected differs depending on what is being detected such as detection of the shifted state of the transmission or detection of the operational state of the brake. Therefore, it is necessary to change the detection stroke depending upon the place where the switch device is used. Thus, in the prior art, a plurality of the switch devices are prepared in correspondence to the different amounts of displacement of the portion to be detected, which results in an increased cost.

When a connection terminal of the switch device is to be connected to a lead wire, the connected portion of the switch device is disposed on a bottom of a recess defined in a casing. After connecting the lead wire, a filler is poured into the recess to seal the connected portion from the outside. This creates a problem because a periphery of the recess makes the connecting operation difficult resulting in a degraded operatability or resulting in a connection failure.

SUMMARY OF THE INVENTION

Accordingly, it is an object of the present invention to provide a switch device having a simple construction, wherein sealability is insured between an operating element and a sealing member.

It is another object of the present invention to provide a switch device, wherein an operating element for operating a switch for a switching operation is always accurately operated along a predetermined path.

It is a further object of the present invention to provide a switch device, wherein the detection stroke can be simply changed and adjusted, and the switch device has an enhanced property of being a general purpose device which can accommodate detected portions which are displaced by different amounts.

It is a yet further object of the present invention to provide a sealing method which facilitates the connection between a connection terminal in a switch device of the above-described type and a lead wire and permits such connection to be reliably carried out.

To achieve the above objects, according to the present invention, there is provided a switch device comprising: a casing; a tightly closed switch chamber formed in the casing; a switch provided in the switch chamber; an operating element advanceably and retreatably inserted into the switch chamber through an opening of the casing; and actuating member provided within the switch chamber and connected to an inner end of the operating element for operating the switch; and a sealing member for sealing between the operating element and the opening. The actuating member has a fitting hole comprised of a small diameter portion and a large diameter portion. An inner end of the operating element passes through the sealing member and is fitted into the small diameter portion of the fitting hole. An annular seal clamping portion is formed between an inner peripheral surface of the large diameter portion of the fitting hole and an outer peripheral surface of the operating element. An outer peripheral portion of the sealing member is secured to the casing. An inner peripheral portion of the sealing member is clamped by the seal clamping portion.

With such a construction, the annular seal clamping portion is formed between the actuating member for actuating the switch and the operating element fitted into the actuating member. Also, the inner periphery of the sealing member, with its outer periphery secured to the casing, is clamped by the seal clamping portion. Therefore, even if the sealing member is frequently reciprocally displaced with the advancing and retreating movements of the operating element, in accordance with the repeated ON/OFF operation of the switch device, the sealing member cannot be stripped off or slipped off relative to the operating element, and an intended sealing function thereof can be insured for a long period of time.

In addition to the above construction, if a cylindrical clamped portion is provided at a central portion of the sealing member and clamped by the seal clamping portion, the fixing of the inner periphery of the sealing member can be made further reliable.

If the casing is comprised of two halves integrally coupled with each other, and the outer peripheral portion of the sealing member is clamped and fixed between the two halves, the fixing of the sealing member to the casing can be facilitated, and the assembling operation thereof can be simplified.

To achieve the above objects, according to the present invention, there is also provided a switch device, comprising: a casing; a switch chamber formed in the casing; a switch provided in the switch chamber; and an actuating device supported in the casing for operating the switch for a switching operation in front and rear directions. The actuating device includes a switch-operating portion provided at an intermediate portion of the actuating device for operating the switch for a switching operation, and front and rear rod portions provided at front and rear opposite ends of the actuating device and slidably supported in front and rear guide holes provided in the casing, respectively.

With the above construction, since the front and rear rod portions are provided at front and rear opposite ends of the actuating device and slidably supported at two points in front and rear guide holes provided in the casing, the actuating device is always accurately reciprocally moved along a predetermined path during switching operation and cannot produce a "fall-down" and a "deflection". As a result, the switching accuracy of the switch device can be substantially enhanced, leading to a remarkably increased reliability of the switch device.

In addition to the above construction, if the actuating device includes a spring seat surface provided thereon for receiving one end of a spring for biasing the actuating device in either a forward or rearward direction, and a spring guide is provided thereon for guiding expanding and contracting operations of the spring, the spring accurately resiliently biases the actuating device in one of the moving directions, thereby further considerably enhancing the switching accuracy.

Also, if a spring shoe for supporting the other end of the spring is provided on the casing, the resilient biasing of the actuating device by the spring can be made further reliable.

To further achieve the above object, there is provided a switch device, comprising: a casing; a switch chamber formed in the casing; a switch provided in the switch chamber and comprised of a stationary contact and a movable contact; and an actuating device advanceably and retreatably disposed within the switch chamber. The switch is moved for a switching operation by a displacement of the actuating device exceeding a predetermined stroke. The actuating device includes an adjusting member detachably mounted thereto for variably adjusting the stroke.

With the above construction, the switch device can be for any of various switches having different detection stroke amounts, leading to a substantially enhanced property of being a general purpose device which can reduce the cost of the switch device.

In the above construction, the actuating device may include a switch-operating portion opposed to the movable contacts of the switch, and a rod portion extending from the switch operating portion in a direction of displacement of the actuating device. The adjusting member may be interposed between the switch operating portion and the movable contact and detachably fitted over the rod portion. If so, it is possible to change the detection stroke amounts only by replacing the adjusting member selectively with another adjusting member to fit the latter over the rod member, and to extremely facilitate such changing.

In the above construction, if the rod portion of the actuating device is advanceably and retreatably passed through a hole centrally provided in the movable contact and slidably supported in a guide hole defined in the casing, the positioning of the rod portion of the actuating device relative to the movable contact is facilitated, and the assemblability is enhanced.

In addition, the adjusting member may be formed into a collar having a predetermined thickness and opposed to the movable contact at a predetermined distance in one of the switched states of the switch. Thus, it is possible to easily set the stroke amount of the switch device.

The switch may include connection terminals exposed to one end face of the casing and connected to lead wires, respectively. The switch device may further include a cylindrical sealing cap through which the wires are inserted. The cylindrical sealing cap is secured to the casing to define a recess surrounding the connected portions of the connection terminals and the lead wires. A potting material is filled into the recess. Thus, it is possible to reliably seal the connected portions.

In a method for sealing the connected portions of the lead wires, the lead wires may be first connected to the connection terminals exposed to the one end face of the casing, and then, the sealing cap may be secured to the casing to define the recess around the connected portion. Thereafter, the potting material may be filled into the recess. In this sealing method, there is no problem that the connecting operation is obstructed by the recess-defining member. The connection of the lead wire to the connection terminal can be reliably carried out, leading to a substantially enhanced connecting efficiency and contributing to a reduction in cost, as compared with a method which involves connecting the lead wire and the connection terminal to each other after previous provision of the recess.

If a holding portion, through which the lead wires are inserted and retained, is integrally formed on the sealing cap, the need for a clamp member used for removing the lead wire is eliminated. In addition, even if a tensile force is applied to the lead wire after connection of the lead wire, the force cannot be applied directly to the connected portion of the lead wire and thus, the lead wire is prevented from being slipped off from the connected portion.

The above and other objects, features and advantages of the invention will become apparent from the following description of the preferred embodiments taken in conjunction with the accompanying drawings.

Incidentally, throughout the description of this specification, the term "forward to rearward directions" means the directions of advancing and retreating movements of the operating element of the switch device, and more specifically, "the forward direction" is the direction in which a steel ball engaging the operating element is projected out the casing, and "the rearward direction" is the direction in which the steel ball is retracted into the casing.

BRIEF DESCRIPTION OF THE DRAWINGS

The accompanying drawings illustrate several embodiments of the present invention.

FIGS. 1 to 3 illustrate a first embodiment of the present invention, wherein FIG. 1 is a vertical sectional view of a switch device according to the first embodiment;

FIG. 2 is an exploded perspective view of the switch device; and

FIG. 3 is a perspective view of a push disc, a push rod and an adjusting collar;

FIGS. 4 to 6 illustrate a second embodiment of the present invention, wherein

FIG. 4 is a vertical sectional view of a switch device according to the second embodiment;

FIG. 5 is an exploded perspective view of the switch device; and

FIG. 6 is an exploded perspective view for illustrating steps of connecting the connected portions of connection terminals of the switch device and lead wires.

DESCRIPTION OF THE PREFERRED EMBODIMENT

The present invention will now be described by way of preferred embodiments with reference to the accompanying drawings.

Figure 1:
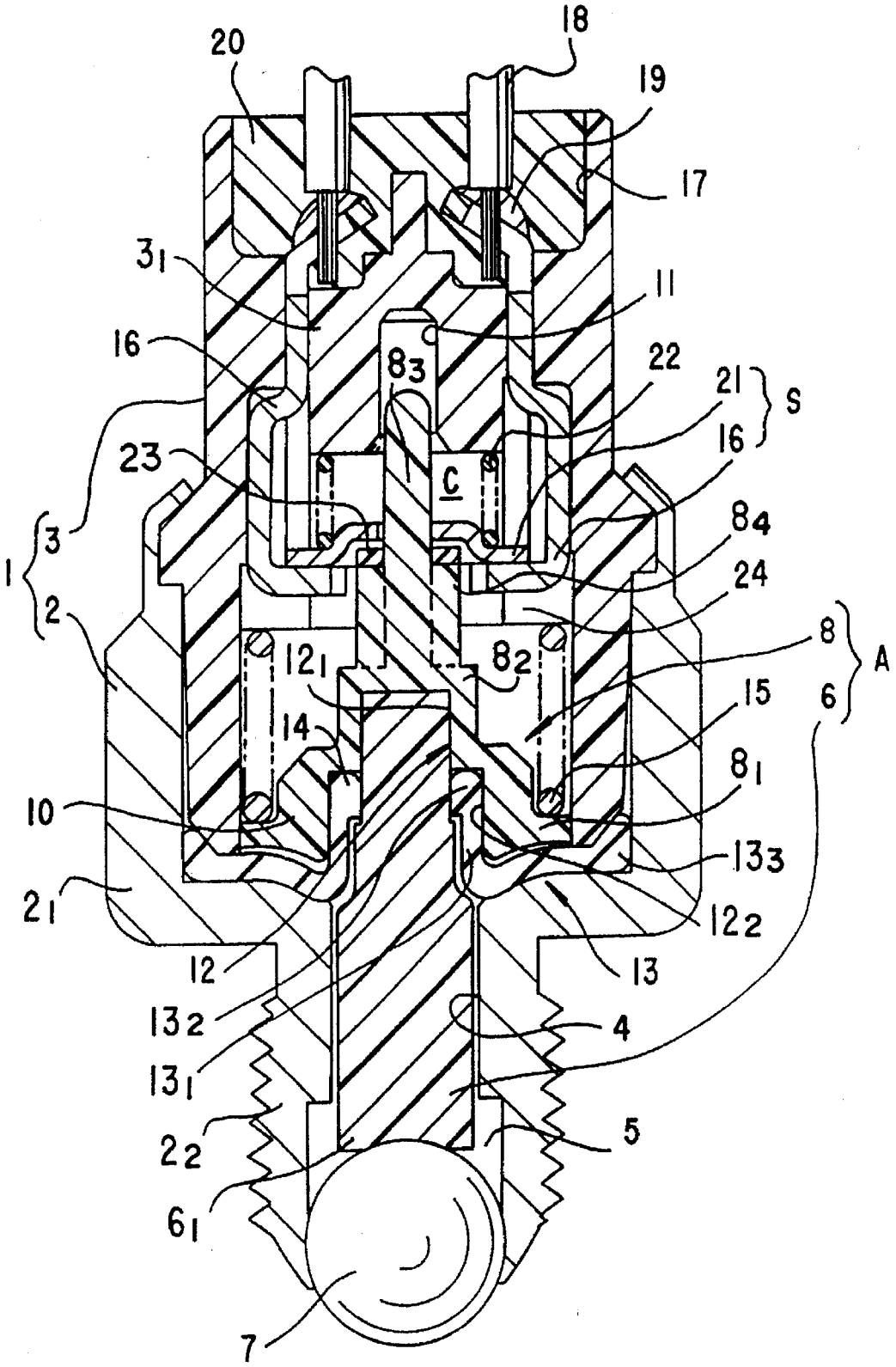
Figure 2:
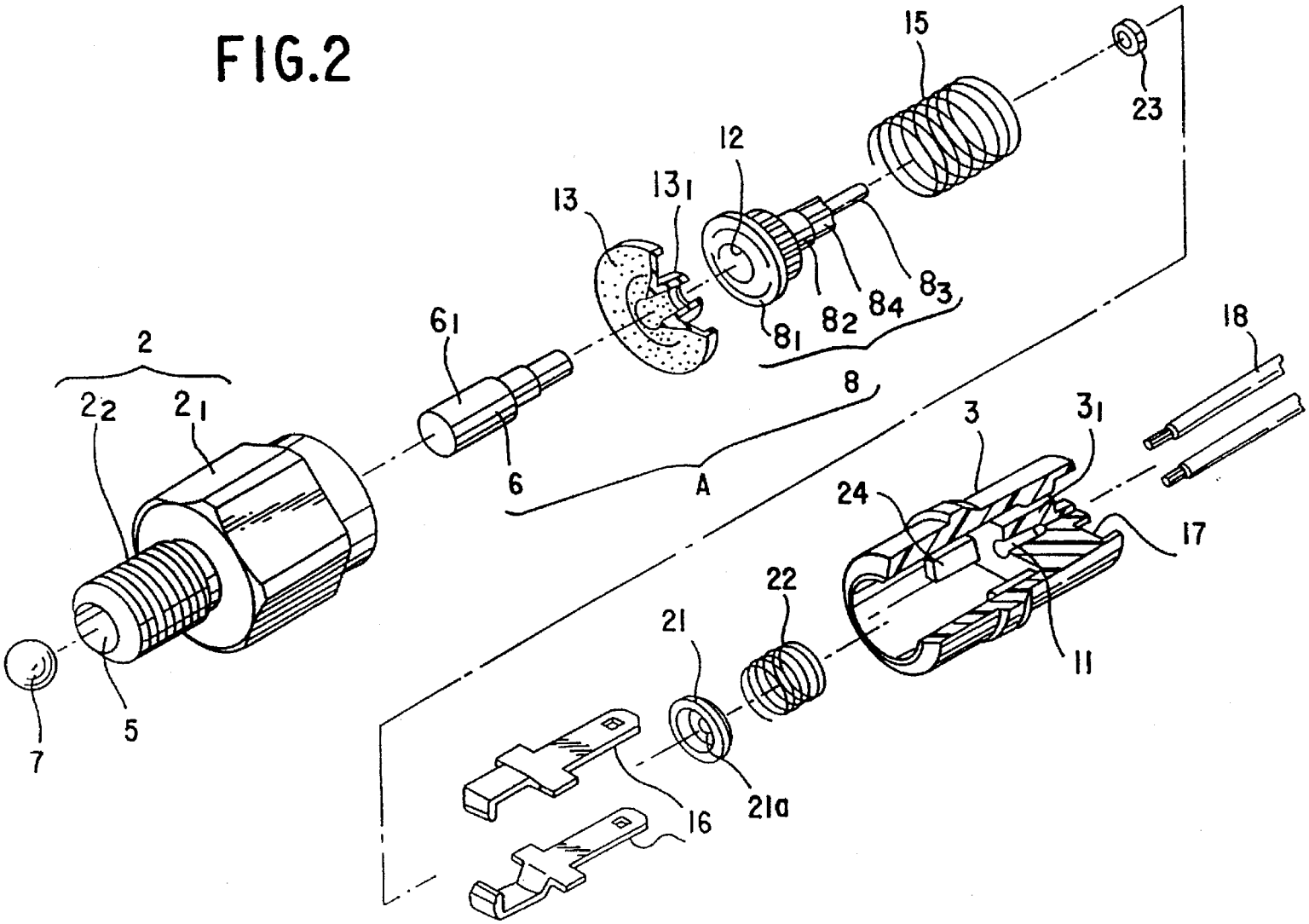
Figure 3:
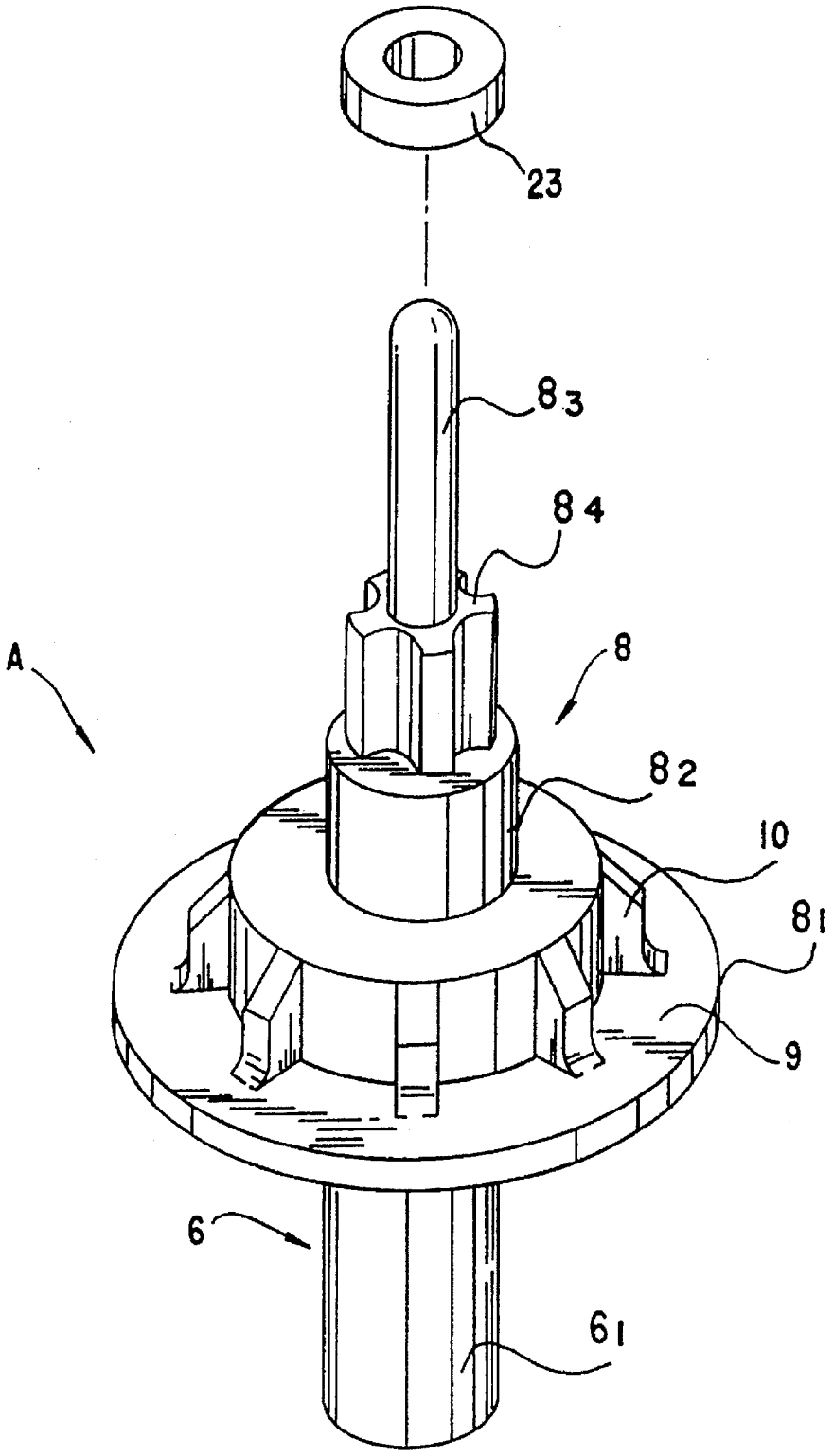

FIGS. 1 to 3 illustrate a first embodiment.

A casing 1 of a switch device according to this embodiment includes a case body 2 made of metal as a first half, and a base member 3 as a second bottomed cylindrical half made of insulating hard synthetic resin. A front half portion of the base member 3 is inserted into and integrally coupled to a large diameter base portion of the case body 2. A switch chamber C is defined in the casing 1 and surrounded by an inner peripheral surface of the base member 3. A switch S, which will be described hereinafter, is mounted in the switch chamber C.

The case body 2 includes a large diameter base portion $2_1$ having an outer peripheral surface formed into a polygonal shape, and a leading portion $2_2$ with a diameter smaller than that of the base portion $2_1$. The leading portion $2_2$ integrally projects forwardly, i.e., downwardly as viewed in FIG. 1, from a central portion of the base portion $2_1$, and has external threads formed around an outer periphery of the leading portion $2_2$. A front guide hole 4 is formed in the leading portion $2_2$ and has an inner end which opens into the switch chamber C, and an outer end which communicates with an opening 5 at a tip end of the leading portion $2_2$. A front rod portion $6_1$, of a push rod 6 made of synthetic resin as an operating element, is slidably inserted into the guide hole 4. A rear end of the push rod 6 is protruded into the switch chamber C. A front end of the push rod 6 faces the opening 5. A steel ball 7 is carried in the opening 5 for movement into and out of the opening 5. A tip end of the front rod portion $6_1$ of the push rod 6 engages an inner surface of the steel ball 7. Thus, the forward sliding movement (downward sliding movement as viewed in FIG. 1) of the push rod 6 causes the steel ball 7 to be pushed to protrude out of the opening 5. If the steel ball 7 is pushed inwardly, the push rod 6 is slid rearwardly (upwardly as viewed in FIG. 1).

A push disc 8 made of synthetic resin as an actuating member is axially movably accommodated in the switch chamber C. As clearly shown in FIG. 3, the push disc 8 includes a disc portion $8_1$, a stepped shaft portion $8_2$ on a back of the disc portion $8_1$, and a rear rod portion $8_3$ integrally extending axially rearwardly from the center of the stepped shaft portion $8_2$. The rear rod portion $8_3$ is formed at its base with a switch operating portion $8_4$ for operating the switch S into an OFF state. A spring seat surface 9 for a return spring 15 is also formed on the back of the disc portion $8_1$. A spring guide 10 for the return spring 15, which comprises a plurality of radially projecting ribs, is integrally formed around an outer periphery of a large diameter section of the stepped shaft portion $8_2$. The outer periphery of the disc portion $8_1$ is movably fitted to an inner surface of the base member 3. The rear rod portion $8_3$ is slidably inserted into a rear bottomed guide hole 11 provided in a rear end wall $3_1$ of the base member 3. At a central portion, the disc portion $8_1$ of the push disc 8 is provided with a bottomed fitting hole 12 which opens forwardly and has a small diameter portion $12_1$ and a large diameter portion $12_2$. The rear end of the push rod 6 is tightly inserted into the small diameter portion $12_1$ of the fitting hole 12. The push disc 8 and the push rod 6 are axially movable in unison with each other and cooperated to constitute an actuating means A for operating the switch S (which will be described hereinafter) for a switching operation by displacement in an amount exceeding a predetermined stroke amount.

A disk-like sealing member 13 for liquid-tightly sealing the switch chamber C from the outside is disposed between an inner end wall of the base portion $2_1$ of the case body 2 and the disc portion $8_1$ of the push disc 8. The sealing member 13 is formed from flexible material such as soft synthetic resin, rubber and the like. The sealing member 13 is integrally formed at its central portion with a cylindrical clamped portion $13_1$, and is integrally formed around its inner and outer peripheries with bead-like expanded portions $13_2$ and $13_3$, respectively. The inner end of the push rod 6 is passed through the cylindrical clamped portion $13_1$ of the sealing member 13. The clamped portion $13_1$ is tightly clamped with a proper margin by an annular seal clamping portion 14 formed between an inner peripheral surface of the large diameter portion $12_2$ of the fitting hole 12 and an outer peripheral surface of the push rod 6. An outer periphery of the sealing member 13 is tightly clamped and fixed between the inner end wall of the base portion $2_1$ of the case body 2 and an inner end edge of the base member 3.

A compressed return spring 15 as a spring means is compressed between a spring shoe 24 integrally formed on the inner surface of the base member 3 of the casing 1, and the spring seat surface 9 formed on the back of the disc portion $8_1$. The return spring 15 engages with the spring guide 10 comprising the plurality of ribs, and is guided by the spring guide 10 for smooth and reliable expansion and contraction in an axial direction. A resilient force of the return spring 15 biases the actuating means A comprising the push disc 8 and the push rod 6 forwardly to move the steel ball 7 out of the opening 5. A pair of stationary contacts 16 are disposed in a rear portion of the switch chamber C with a phase difference of approximately 180° in the circumferential direction. A base portion of each of the stationary contacts 16 is inserted into and supported in the rear end wall $3_1$ of the base member 3. An outer end of the stationary contact 16 is exposed as a connection terminal into a recess 17 defined at the rear end of the base member 3, and connected in the recess 17 to a lead wire 18 by soldering 19. A potting material 20 such as an epoxy resin is filled in the recess 17 to cover and fix the connected portion 19.

A disk-like movable contact 21 is disposed in an opposed relation to inner bent ends of the pair of stationary contacts 16. A coiled switch spring 22 is compressed between a back of the movable contact 21 and an inner surface of the rear end wall $3_1$ of the base member 3, such that a resilient force of the switch spring 22 biases the movable contact 21 into contact with the stationary contacts 16, as shown in FIG. 1. The switch S is constructed by the stationary contacts 16 and the movable contact 21.

An adjusting member or collar 23 for adjusting the detected stroke is detachably fitted over the rear rod portion $8_3$ and seated on the switch operating portion $8_4$ formed at an intermediate portion of the actuating means A, i.e., at the base of the rear rod portion $8_3$ of the push disc 8, i.e., at a boundary between the rear rod portion $8_3$ and the stepped shaft portion $8_2$. The rear rod portion $8_3$ of the push rod 8 is advanceably and retreatably passed through a hole 21*a* formed at a central portion in the movable contact 21. Therefore, the collar 23 is located between the switch operating portion $8_4$ and the movable contact 21, and an upper surface of the collar 23 faces the movable contact 21 at a predetermined distance. When the actuating means A is retreated through the steel ball 7 by an object to be detected, the switch operating portion $8_4$ upwardly pushes the movable contact 21 through the collar 23, thereby operating the switch into an OFF state. By replacing the collar 23 by another member having a different thickness, it is possible to adjust the amount of displacement stroke of the actuating means A, i.e., the detected stroke which the switch device receives from the object to be detected.

The operation of this embodiment will be described below.

When the switch S is in its free state, as shown in FIG. 1, the movable contact 21 has been biased toward the stationary contacts 16, under the resilient force of the switch spring 22, to come into contact with the stationary contacts 16 and thus, the switch S is in an ON state.

When the steel ball 7 receives an external force from the object to be detected in this ON state, the steel ball 7 is moved inwardly against the resilient force of the return spring 15, and the actuating means A (comprising the push rod 6 and the push disc 8) which engages the steel ball 7 is displaced rearwardly (upwardly as viewed in FIG. 1) within the switch chamber C. Thus, the actuating means A moves the movable contact 21 rearwardly, by the collar 23, against the resilient force of the switch spring 22 away from the stationary contacts 16. As a result, the switch S is brought into the OFF state. When the external force acting on the steel ball from the object to be detected is released, the resilient force of the return spring 15 causes the actuating means A to be advanced, until the steel ball 7 reaches its protruding position. This causes the movable contact 21 to be released from an urging force of the collar 23 and brought into contact with the stationary contacts 16 by the resilient force of the switch spring 22, thereby again bringing the switch into the ON state.

The amount of displacement stroke of the actuating means A for operating the switch S for a switching operation is determined by the thickness of the collar 23. Therefore, the amount of displacement stroke of the actuating means A can be change by replacement of the collar 23 with another collar having a different thickness. For example, when the switch device is used for detecting the shifted state of the transmission or the operational state of a foot brake in a vehicle, even if there is a difference between detected stroke amounts from the object to be detected, it is possible to detect both such states only by replacing the collar 23 having a different thickness.

The actuating means A is supported at two points with its front and rear rod portions $6_1$ and $8_3$ slidably fitted in the front and rear guide holes 4 and 11, respectively, and is provided at the intermediate portion thereof with the switch-operating portion $8_4$. Therefore, whenever the switching operation of the actuating means A is carried out, the switch-operating portion $8_4$ can be guided into and accurately slid longitudinally in the front and rear guide holes 4 and 11 to reliably provide the engagement and disengagement of the movable contact 21. Even if the switching operation is frequently repeated, the high accuracy switching operating of the actuating means A can be insured without producing "inclination" and/or "deflection" with respect to an axis defined by the front and rear guide holes 4 and 11.

The sealing member 13 is reciprocally displaced in a manner to follow the reciprocal movements of the push rod 6 constituting the actuating means A to provide a liquid-tightly sealing between the switch chamber C and the outside so as to prevent ingress of an external transmission oil or the like into the switch chamber C. The cylindrical clamped portion $13_1$ of the sealing member 13, having the expanded portion $13_2$, is reliably tightly clamped with a predetermined clamping force by the annular seal clamping portion 14 formed between the outer periphery of the push rod 6 and the inner periphery of the bottomed fitting hole 12 in the push rod 8. Therefore, an intended sealing function of the sealing member 13 can be insured for a long period without the "strip-off" or "slip-off" of the sealing member 13 relative to the push rod 6, even if the sealing member 13 is frequently reciprocally displaced along with the push rod 6 whenever the ON/OFF operation of the switch S is carried out.

Although the switch device has been described in the first embodiment as being used for detection of the shifted state of the transmission in the vehicle as one example, this switch device can be carried out, as a matter of course, as a common switch device which is operated in the ON/OFF manner under an external force. In the above-described first embodiment, the clamped portion of the sealing member has been formed into a cylindrical shape, but may be of another shape. For example, the clamped portion may be a lip piece. Further, in the first embodiment, the actuating means has been constructed by coupling the push rod and the push disc, but may be constructed from a push rod and a push disc integral with each other, or may be constructed from three or more members. In the first embodiment, the actuating means permits the switch to be biased into the OFF state by the resilient force of the return spring, but the construction may be such that the resilient force of the return spring biases the switch into the ON state.

Figure 4:
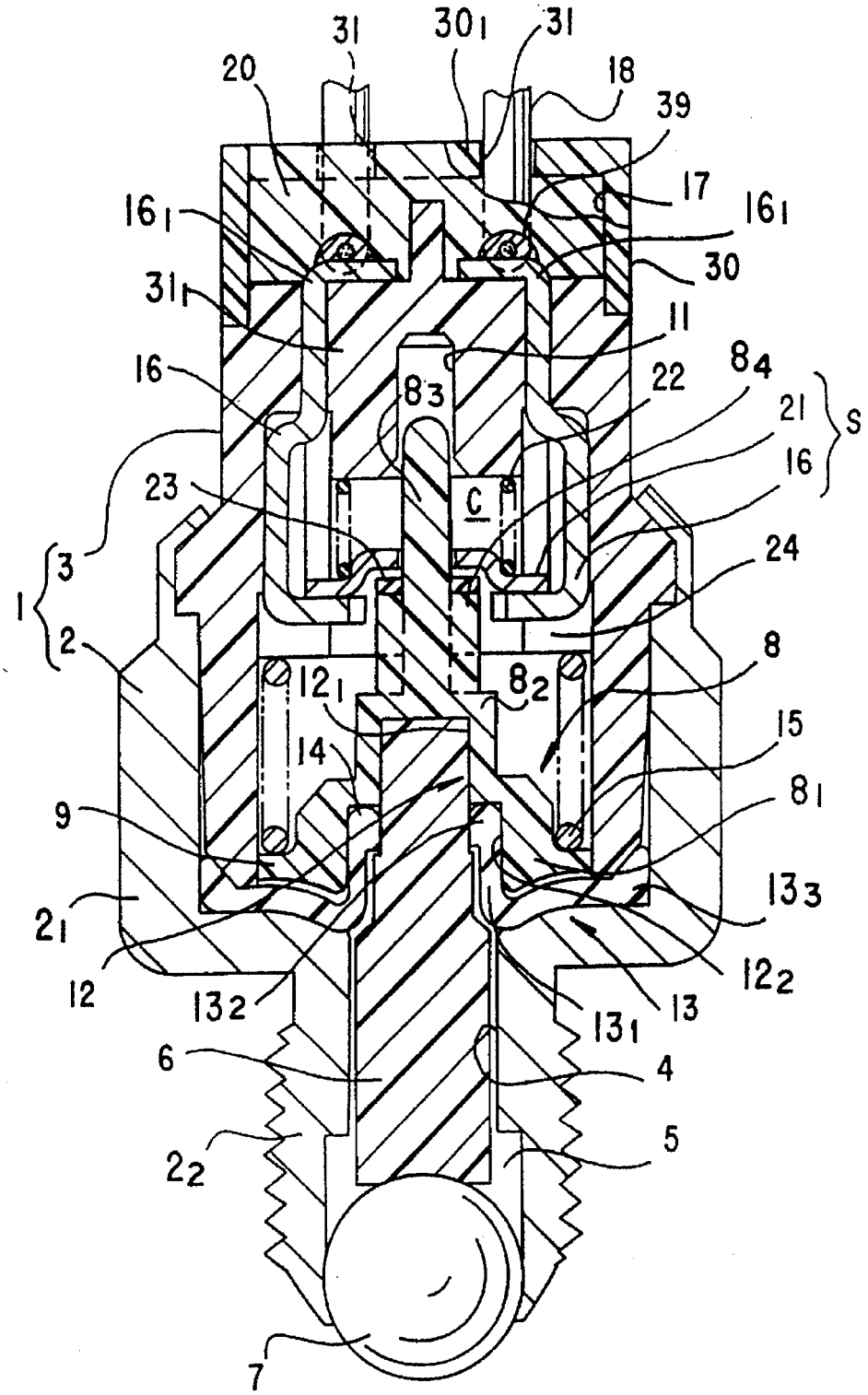
Figure 5:
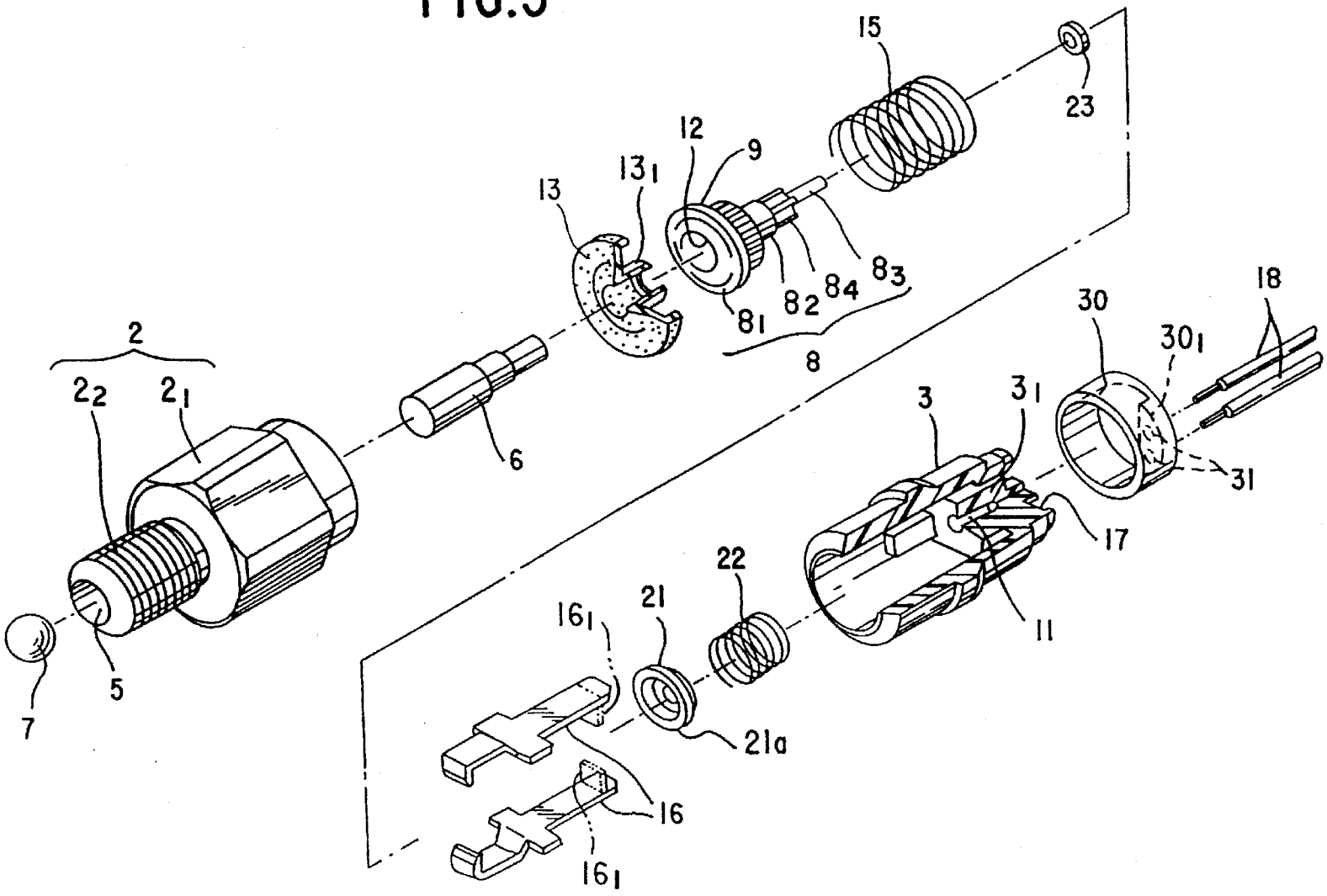
Figure 6:
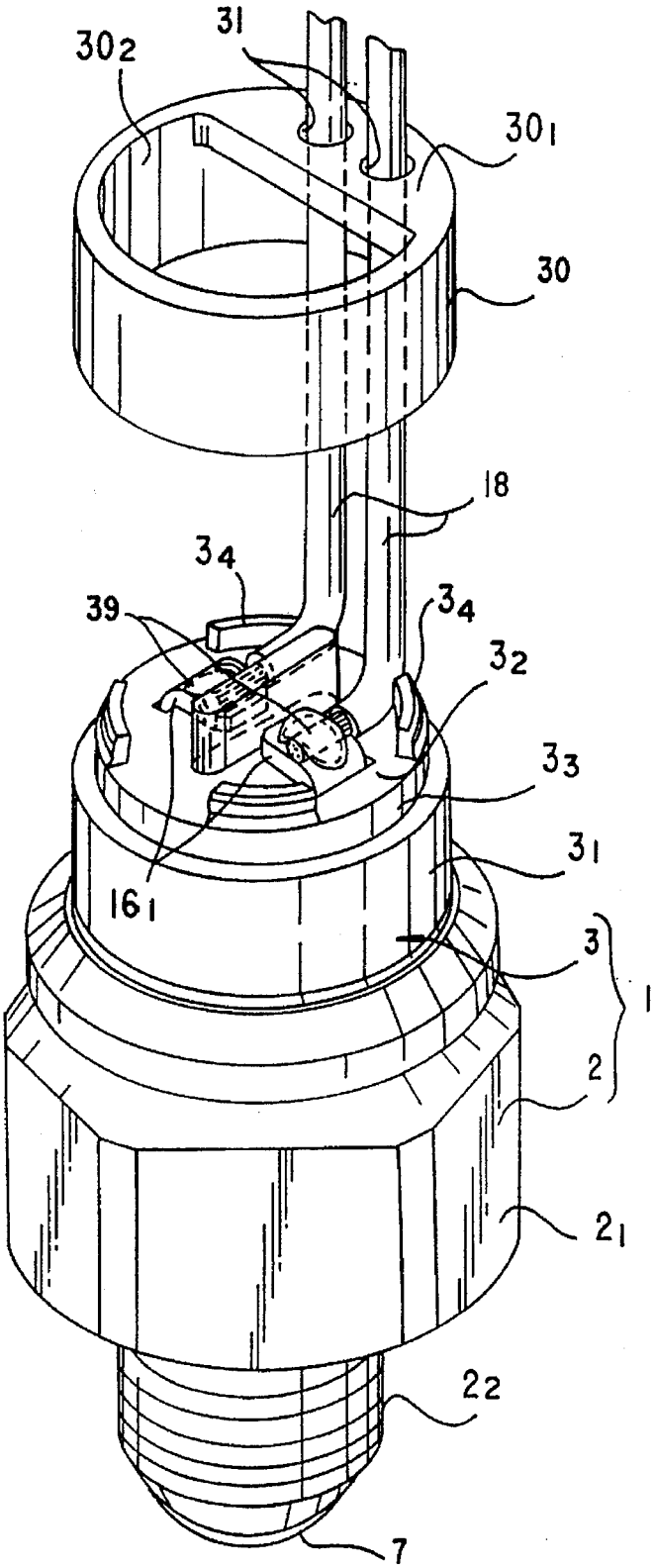

FIGS. 4 to 6 illustrate a second embodiment. The arrangement other than the connection between the switch S and the lead wire 18 is substantially the same as in the first embodiment and hence, the portions or components are designated by like reference characters and the description thereof is omitted.

As best shown in FIG. 6, in the second embodiment, a connection terminal $16_1$ at a free end of a stationary contact 16 is bent and superposed on a rear end face of a base member 3.

As also shown in FIG. 6, a stepped male fitting portion $3_3$ is formed at a rear end of the base member 3 and several guide pieces $3_4$ are projectingly provided on the male fitting portion $3_3$. A short cylindrical sealing cap 30 made of insulating material such as rubber, synthetic resin or the like is fit over and secured to the male fitting portion $3_3$. A minor arc-shaped holding portion $30_1$ is integrally formed at one side of an end face of the sealing cap 30 and provided with a pair of insertion holes 31 as a first hole portion through which lead wires 18 are inserted. The remaining portion the end face of the sealing cap forms a second hole portion $30_2$ or window portion.

The two lead wires 18, after being inserted through the pair of insertion holes 31, are connected at their ends of the connection terminals $16_1$ of the stationary contacts 16 by a connecting means such as soldering or the like. Then, the sealing cap 30 is fit and secured to the male fitting portion $3_3$ of the base member 3, whereby the periphery of a connected portion 39 is surrounded by the sealing cap 30. A potting material 20, such as an epoxy resin, is poured into the second hole portion $30_2$ and filled in a recess 17 defined by the rear end face $3_2$ of the base member 3 and the sealing cap 30 to seal the connected portion 39 between the connection terminal $16_1$ and the lead wire 18.

In this connecting operation, before the sealing cap 30 is fit and secured to the base member 3 as shown in FIG. 6, the lead wire 18 inserted through the sealing cap 30 is connected to the connection terminal $16_1$ which is in an exposed state with its periphery opened. Therefore, the operation of connecting the lead wire 18 to the connection terminal $16_1$ is reliable and extremely easy and can be done in a substantially reduced time.

The sealing cap has been cylindrical in the above-described embodiment, but may be of polygonal tubular shape. Further, the sealing cap has been secured to the base member after insertion of the lead wire through the sealing cap in the above-described embodiment, but the lead wire may be inserted through the sealing cap after securing of the sealing cap to the base member.

From the foregoing description of the preferred embodiments of the invention, it will be apparent that many modifications may be made therein. It should be understood that these embodiments are intended as one example of the invention only, and that the invention is not limited thereto. Therefore, it should be understood that the appended claims are intended to cover all modifications that fall within the true spirit and scope of the invention.

What is claimed is:

1. A method for sealing connected portions of lead wires with connection terminals of a switch device, comprising the steps of:

preparing a sealing cap having a first hole portion for holding said lead wires and a second hole portion;

connecting said lead wires to said connection terminals which are exposed on one end face of a casing;

securing said sealing cap to said casing with said lead wires passing through said first hole portion of the sealing cap therein to define a recess in said sealing cap around said connected portions of the lead wires with the connection terminals; and filling potting material into said recess through said second hole portion of the sealing cap.

2. A sealing method according to claim 1, wherein said first hole portion, through which said lead wires are inserted and retained, is integrally formed on said sealing cap.

3. A sealing method according to claim 1, further comprising the steps of determining a position of said second hole portion in said sealing cap so as to be opposed to the connected portions of said lead wires with said connection terminals when said sealing cap is secured to said casing.

* * * * *